US011634853B2

(12) United States Patent
O'Malley et al.

(10) Patent No.: US 11,634,853 B2
(45) Date of Patent: Apr. 25, 2023

(54) SYSTEM FOR DETECTING DRAINAGE FLOW OBSTRUCTIONS IN WASHING APPLIANCES

(71) Applicant: Centrica PLC, Windsor (GB)

(72) Inventors: Nicholas O'Malley, Windsor (GB); Sean Stephenson, Windsor (GB)

(73) Assignee: Centrica PLC, Windsor (GB)

( * ) Notice: Subject to any disclaimer, the term of this patent is extended or adjusted under 35 U.S.C. 154(b) by 169 days.

(21) Appl. No.: 16/816,869

(22) Filed: Mar. 12, 2020

(65) Prior Publication Data

US 2020/0291564 A1 Sep. 17, 2020

(30) Foreign Application Priority Data

Mar. 13, 2019 (GB) ..... 1903456

(51) Int. Cl.
*D06F 39/08* (2006.01)
*D06F 33/42* (2020.01)
(Continued)

(52) U.S. Cl.
CPC ..... *D06F 39/082* (2013.01); *A47L 15/0031* (2013.01); *A47L 15/0049* (2013.01);
(Continued)

(58) Field of Classification Search
CPC .... D06F 39/082; D06F 33/47; A47L 15/0049; A47L 2401/08
See application file for complete search history.

(56) References Cited

U.S. PATENT DOCUMENTS

2009/0056756 A1 3/2009 Son
2012/0111372 A1* 5/2012 Hesterberg ..... A47L 15/0049 134/25.2
(Continued)

FOREIGN PATENT DOCUMENTS

CN 108185962 A 6/2018
EP 0028067 A1 5/1981
(Continued)

OTHER PUBLICATIONS

Combined Search and Examination Report under Sections 17 and 18(3) issued by the Intellectual Property Office of the United Kingdom in Application No. GB 1903456.0 dated Sep. 13, 2019. 7 pages.

*Primary Examiner* — Spencer E. Bell
(74) *Attorney, Agent, or Firm* — Meunier Carlin & Curfman LLC

(57) ABSTRACT

A method of monitoring drainage of a washing appliance such as a dishwasher or washing machine having a pump for draining a washing chamber is disclosed. The method includes receiving a time series of power consumption data relating to the operation of the washing appliance over a monitored period of operation including pumped draining of the washing chamber. A measure of the duration of a portion of the monitored period comprising said pumped draining is derived from the time series of power consumption data. The measure of duration is then compared to a reference value and an indicator of a drainage condition is determined based on the comparison. The method may be used to detect scaling or blockages in drainage flow paths.

18 Claims, 14 Drawing Sheets

(51) Int. Cl.

| | |
|---|---|
| ***D06F 34/10*** | (2020.01) |
| ***A47L 15/00*** | (2006.01) |
| ***D06F 103/48*** | (2020.01) |
| ***D06F 105/58*** | (2020.01) |
| ***D06F 105/08*** | (2020.01) |

(52) U.S. Cl.
CPC ..... *D06F 33/42* (2020.02); *D06F 34/10* (2020.02); *A47L 2401/08* (2013.01); *A47L 2501/26* (2013.01); *D06F 2103/48* (2020.02); *D06F 2105/08* (2020.02); *D06F 2105/58* (2020.02)

(56) References Cited

U.S. PATENT DOCUMENTS

| | | | | |
|---|---|---|---|---|
| 2013/0291896 | A1 | 11/2013 | Durham et al. | |
| 2015/0265128 | A1 | 9/2015 | Pers et al. | |
| 2017/0135550 | A1 | 5/2017 | Shin et al. | |
| 2020/0003659 | A1* | 1/2020 | Davies ..... | G01R 19/2513 |

FOREIGN PATENT DOCUMENTS

| | | | |
|---|---|---|---|
| FR | 2993166 | A1 | 1/2014 |
| GB | 2479790 | A | 10/2011 |
| JP | H05115414 | A | 5/1993 |
| KR | 100186294 | B1 | 5/1999 |

* cited by examiner

SYSTEM FOR DETECTING DRAINAGE FLOW OBSTRUCTIONS IN WASHING APPLIANCES

CROSS REFERENCE TO RELATED APPLICATIONS

This application claims the benefit of and priority to United Kingdom Patent Application No. GB 1903456.0 filed on Mar. 13, 2019, the disclosure of which is expressly incorporated herein by reference in its entirety.

FIELD OF THE INVENTION

The present invention relates to systems and methods for detecting flow obstructions in the flow of water discharged from washing appliances, such as dishwashers and washing machines.

BACKGROUND

Blockages and other flow obstructions are a major cause of dishwasher and washing machine failures.

Dishwashers can become blocked due to build-up of lime scale within the circulation system that circulates water through the machine. Fat and detergent residue can also accumulate in the pipes which gradually restricts water intake, causing the dishwasher's performance to deteriorate due to insufficient supply of wash water.

Blockages in dishwashers can also manifest in the water outlet system. The appliance typically drains the water through an impeller pump, with the water subsequently flowing through the appliance's drain hose to a waste point within a home or business. These various parts of the discharge flow path all represent potential failure points within the drain circuit.

Washing machines are also prone to failures in the drain circuit (which is similar in principle to a dishwasher's drain circuit). Problems can be caused by small items of clothing or other foreign objects such as coins or hairclips slipping through the gap in the drum and entering the drain pipe. Lime scale build-up or detergent residue can also cause blockages.

Some surveys have identified significant numbers (e.g. around 40%) of breakdowns in dishwashers and washing machines to be caused by restrictions and blockages.

SUMMARY

Accordingly, embodiments of the invention seek to provide approaches for detecting certain problematic drainage conditions such as scale build-up and blockages in the discharge flow of washing appliances.

In a first aspect of the invention, there is provided a method of monitoring drainage of a first washing appliance having a pump for draining a washing chamber, the method comprising: receiving a time series of power consumption data relating to the operation of the first washing appliance over a monitored period of operation including pumped draining of the washing chamber; deriving, from the time series of power consumption data, a measure of the duration of a portion of the monitored period comprising said pumped draining; comparing the measure of duration to a first reference value; and determining an indicator of a drainage condition based on the comparison.

Using this approach, drainage pump efficiency can be inferred from power consumption data of an appliance, and a variety of drainage conditions affecting drainage flow rate may be detected, such as scaling, blockages, pipe damage (e.g. dents and kinks in flexible pipes).

The reference value may define an expected value for the duration, based e.g. on known operation of the appliance or appliance type and/or based on past measurements for the specific appliance or equivalent appliances. Thus, the reference value may be predetermined, optionally as a (fixed) reference value determined independently of the operation of the first washing appliance and/or determined for an appliance type corresponding to the first washing appliance. Alternatively, the reference value may be determined based on one or more previous measures of duration of (corresponding) operating periods comprising pumped draining determined for the first washing appliance. Thus, the newly measured duration may be compared to historic measures of duration determined for the same appliance.

The drainage condition may comprise an obstructed drainage path from the washing appliance (this may include e.g. obstruction within the appliance, within a flow path e.g. pipe(s) specific to/immediately connected to the appliance and leading to a shared drainage outlet, and/or within a shared drainage outlet to which multiple appliances may be connected).

If the measured value of duration is greater than said reference value, optionally by at least a threshold amount, the indicated drainage condition may be identified as an obstructed drainage path from the first washing appliance. A magnitude of the indicator may be determined based on the difference between the measured value and the reference value (e.g. to provide a numerical indication of drainage efficiency or obstruction severity). Conversely, if the measured duration does not exceed the reference value, or does not exceed it by the threshold amount, then the identified drainage condition may indicate normal operation (no obstruction). Thus the threshold may define a tolerance margin specifying when a deviation from the reference value is considered a meaningful divergence indicating a drainage problem.

The time series of power consumption data may be received from one of: the first washing appliance; a power metering device connected to the first washing appliance arranged to measure the power consumption of the appliance; and a power metering device for monitoring overall power consumption at a user environment (e.g. dwelling, house, apartment, building, office, commercial/industrial unit etc.) comprising a plurality of power-consuming devices including the appliance. In that case, the method preferably further comprises processing a power consumption signal for the plurality of devices to determine the time series of power consumption data for the first washing appliance and/or the drainage pump of the appliance, optionally by disaggregating the power consumption signal to identify a contribution to the signal from the appliance and/or drainage pump.

Deriving a measure of the duration preferably comprises identifying, from the power consumption data, start and end points of a cycle of operation of the appliance, and using the total duration of a cycle of operation of the appliance as said measure. This may provide a measure indirectly indicative of the duration of pumped drainage (e.g. if pumped drainage is considered the likely main source of variation in cycle duration).

Alternatively, deriving a measure of the duration may comprise identifying, from the power consumption data, periods of operation of a predetermined component of the appliance, optionally a heating element of the appliance, and using a duration between identified periods as said measure (e.g. between any two successive or non-successive periods). This may again provide an indirect indication of duration of pumped drainage, for example if it is known that the pump operates between two heating element activations.

As a further alternative, the measure of duration may be a measure of the duration of said pumped draining. Thus, deriving a measure of the duration of pumped draining may comprise identifying, from the power data, start and end points of operation of the pump of the washing appliance and determining the measure from the start and end points (e.g. as the difference between time values for the end point and start point).

The reference value is preferably a measure directly corresponding to the measure of duration, e.g. in the above examples a measure of whole cycle duration, a measure of an interval between heating element activations, or a measure of pump operation duration (which as previously set out may be predetermined or measured during past operation of the appliance).

Advantageously, the method may further comprise monitoring operation of a second washing appliance having a pump for draining a washing chamber, wherein the first and second appliances share a common drainage outlet, said monitoring comprising deriving a measure of the duration of a portion of operation comprising pumped draining of the washing chamber of the second washing appliance, and comparing said measure of duration to a second reference value; based on comparing the measures of duration and reference values of the first and second washing appliances, determining an indicator of a drainage condition of the first and/or second washing appliances and/or the common drainage outlet. Monitoring/data processing for the second appliance may be performed in the same way as for the first appliance, as set out above.

In a further aspect of the invention, there is provided a method of monitoring drainage of first and second washing appliances connected to a common drainage outlet, said first and second appliances each having a pump for draining a washing chamber, the method comprising: deriving a measure of the duration of pumped draining of the washing chambers of said first and second appliances (for example using the method of the first aspect), and comparing said measures to respective first and second reference values; and determining an indicator of a drainage condition of the first and/or second washing appliances and/or the common drainage outlet, based on the comparison.

The following optional features may be applied to either of the above aspects of the invention.

The drainage condition is preferably at least one of: an obstructed drainage path associated with the first appliance, optionally within the first appliance or in a drainage channel connecting the first appliance to the common drainage outlet; an obstructed drainage path associated with the second appliance, optionally within the second appliance or in a drainage channel connecting the second appliance to the common drainage outlet; and an obstruction in the common drainage outlet.

Preferably, the drainage condition is identified as an obstructed drainage path associated with the first appliance if the measure of duration is greater than the reference value for the first appliance but not the second appliance (optionally by at least a threshold amount). The drainage condition may be identified as an obstructed drainage path associated with the second appliance if the measure of duration is greater than the reference value for the second appliance but not the first appliance (optionally by at least a threshold amount). The drainage condition may be identified as obstruction in the common drainage outlet if the measure of duration is greater than the reference value for both first and second appliances (optionally by at least a threshold amount). Thresholds for each appliance may be the same or different; for example, a specific threshold may be configured for a given appliance based on knowledge of the normal operation of the appliance, typical variability in drainage time during normal operating conditions etc.

In a further aspect of the invention, which may be combined with either of the above aspects, there is provided a method of monitoring drainage of first and second washing appliances connected to a common drainage outlet, said first and second appliances each having a pump for draining a washing chamber, the method comprising: receiving a first data set of power consumption data relating to the operation of the first washing appliance over a monitored period of operation including pumped draining of the washing chamber of the first washing appliance; deriving a first operating characteristic of the operation of the first washing appliance during the monitored period from the first data set; receiving a second data set of power consumption data relating to the operation of the second washing appliance over a monitored period of operation including pumped draining of the washing chamber of the second washing appliance; deriving a second operating characteristic of the operation of the second washing appliance during the monitored period from the second data set; and determining an indicator of a drainage condition of at least one of the first and second washing appliances and the common drainage outlet, based on the operating characteristics derived for the first and second washing appliances. Any of the features of the above aspects of the invention may be applied to this aspect of the invention.

Preferably, the drainage condition is at least one of: an obstructed drainage path associated with the first appliance, optionally within the first appliance or in a drainage channel connecting the first appliance to the common drainage outlet; an obstructed drainage path associated with the second appliance, optionally within the second appliance or in a drainage channel connecting the second appliance to the common drainage outlet; and an obstruction in the common drainage outlet.

Determining an indicator of a drainage condition preferably comprises comparing the first and second operating characteristics to respective first and second expected operating characteristics to identify a deviation from the expected operating characteristics. The expected operating characteristics may be pre-determined or previously measured operating characteristics corresponding to the derived operating characteristics. Derived and expected operating characteristics may e.g. be numerical measures with comparison performed numerically. Deviation of a derived operating characteristic from an expected characteristic may be detected in response to the derived characteristic differing from (e.g. exceeding) the expected characteristic by at least a threshold amount.

The drainage condition is preferably identified as an obstructed drainage path associated with the first appliance if the derived operating characteristic deviates from the expected operating characteristic for the first appliance but not the second appliance. The drainage condition is preferably identified as an obstructed drainage path associated with the second appliance if the derived operating characteristic deviates from the expected operating characteristic for the second appliance but not the first appliance. The drainage condition is preferably identified as an obstruction in the common drainage outlet if the derived operating characteristic deviates from the expected operating characteristic for both first and second appliances.

The first and/or second operating characteristics are preferably indicative of operation of the drainage pump of the respective appliance and may be operating characteristics of the drainage pump. The first and/or second operating characteristics may comprise one or more of: a cycle duration of the washing appliance; a duration between activations of a heater element of the washing appliance; a duration of operation of the drainage pump of the washing appliance; a power consumption of the drainage pump of the washing appliance.

The method may comprise performing a method as set out in the first aspect of the invention for the first washing appliance and/or the second washing appliance to identify a respective drainage condition for said appliance(s) and determining the indicator of drainage condition based on the identified respective drainage condition(s).

The following optional features may be applied to any of the above aspects.

The first and/or second washing appliance may be one of: a dishwasher; and a washing machine.

The method may comprise outputting the determined indicator or the drainage condition, or generating an alert or sending an electronic message indicating the drainage condition based on the determined indicator, optionally in response to the indicator being indicative of a drainage obstruction, the alert or message optionally sent to one or more of: an owner or user of the appliance; a manufacturer or maintenance service provider for the appliance; a computer system for managing appliance and/or plumbing maintenance and/or scheduling repair services.

The invention also provides a system or computing device comprising means, optionally in the form of a processor with associated memory, for performing any method as set out herein, the system optionally further comprising one or more power meters for measuring power consumption of one or more of the washing appliances and/or an interface for communicating with said one or more power meters.

The invention further provides a computer readable medium storing software code adapted, when executed on a data processing system, to perform any method as set out herein.

Any feature in one aspect of the invention may be applied to other aspects of the invention, in any appropriate combination. In particular, method aspects may be applied to apparatus and computer program aspects, and vice versa.

Furthermore, features implemented in hardware may generally be implemented in software, and vice versa. Any reference to software and hardware features herein should be construed accordingly.

BRIEF DESCRIPTION OF THE DRAWINGS

Preferred features of the present invention will now be described, purely by way of example, with reference to the accompanying drawings, in which.

DETAILED DESCRIPTION

Figure 1:
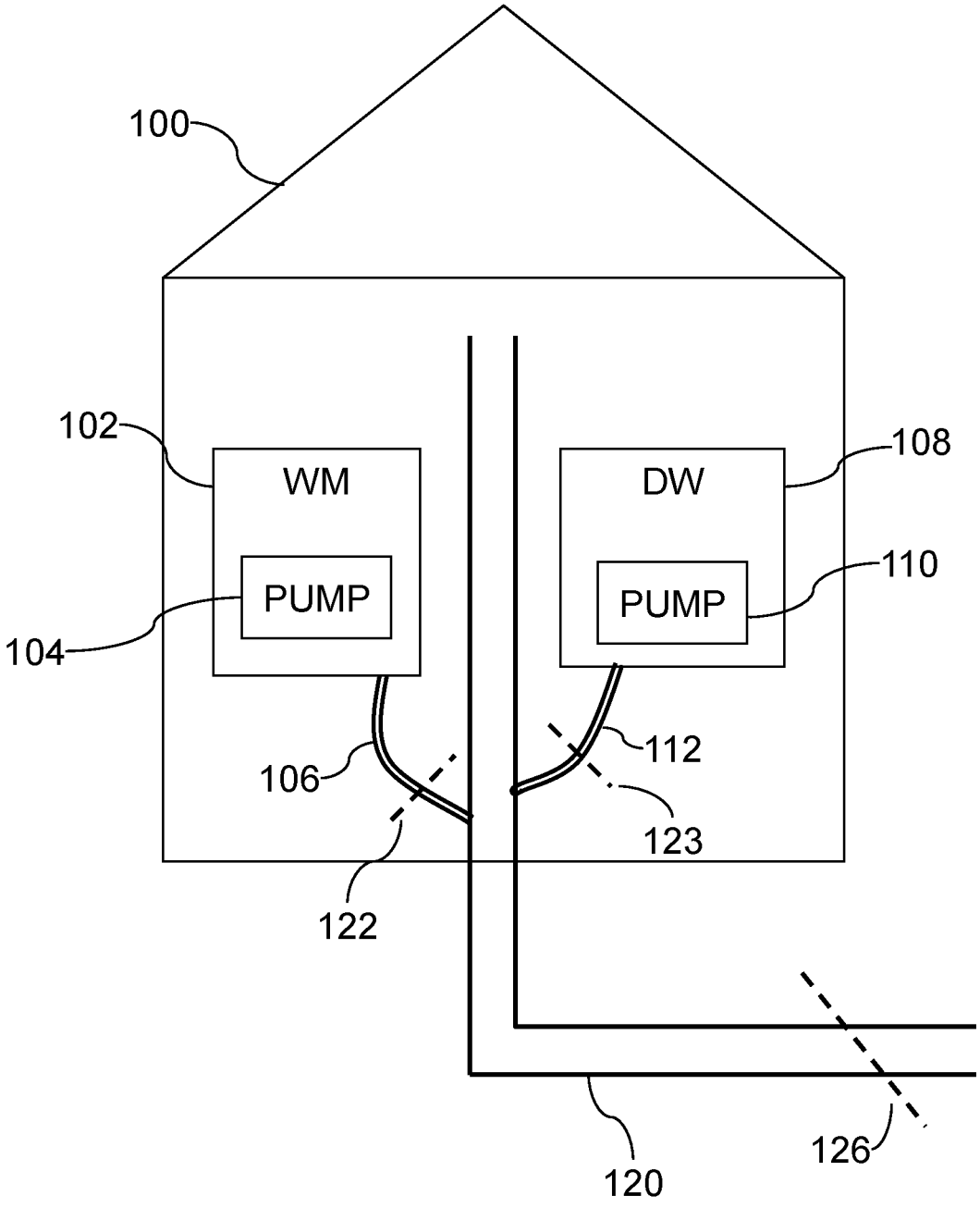
FIG. 1 illustrates a typical installation of multiple washing appliances in a residential property.

FIG. 1 schematically illustrates a typical residential dwelling 100 (e.g. a house or apartment), including a washing machine 102 with an associated drainage pump 104 connected via drainage pipe 106 to a main drainage system 120 for the dwelling. Similarly, a dishwasher 108 installed in the dwelling includes a drainage pump 110 connected via drainage pipe 112 to the main drainage 120.

The washing appliances 102, 108 draw fresh water from a supply network (not shown), perform washing functions for washing clothes and dishes, and pump used water from the appliances using their respective drainage pumps along respective drainage paths including internal flow paths and discharge pipes 106/112 into shared drainage outlet 120.

For the washing machine 102, flow restrictions may occur within the washing machine itself or in the drainage pipe 106 connected directly to the machine (e.g. depicted as flow restriction 122). Flow restrictions in washing machines may typically result from lime scale build-up (especially when using hard water) or detergent residue build-up in the appliance drainage pipe 106. Also, clogging within the machine e.g. at the pump or sump may restrict flow (e.g. from hair, fluff and other foreign objects or materials).

For the dishwasher 108, flow restrictions may similarly occur within the machine 108 or in the drainage pipe 112 connected directly to the machine (e.g. depicted as flow restriction 123). Dishwasher flow restrictions may similarly result from lime scale or detergent residue build up in the appliance drainage pipe 112, and clogging may occur within the machine at the filter, pump and sump pipes (e.g. due to food residue and fat, foreign objects etc.)

Flow restrictions (e.g. flow restriction 126) may also occur in the main drainage system 120 provided in the property and serving as the discharge outlet for both appliances. Such flow restrictions are thus not specific to any one appliance. Typical causes of reduced water flow can include blockage in the water system connected to the appliances or in the pipe work leading to the main sewer, and plumbing faults.

Note the depicted arrangement is simplified and in practice the discharge path from each appliance may include a series of interconnected pipe segments and other plumbing components.

Pipe scaling and other flow obstructions in the discharge path of an appliance may typically reduce the flow rate of waste water being discharged. This in turn may affect the energy consumption signature of the drainage pump (and hence the appliance as a whole) as the pump has to work longer and/or harder. Furthermore, the energy consumption might be expected to change gradually as the scaling becomes more severe.

Embodiments of the invention utilise electricity consumption data for appliances such as washing machines and dishwashers to detect scaling and other flow obstructions within the appliance or within the drainage system outside the appliance. The approach involves identifying the drainage pump's energy consumption pattern in the appliance energy consumption data, and monitoring the pump operation to observe changes in the pump's energy consumption pattern. In a preferred example, changes in duration of operation of the drainage pump are used as the main indicator for drainage conditions such as reduced drainage efficiency caused by scale build-up and other blockages.

Figure 2A:
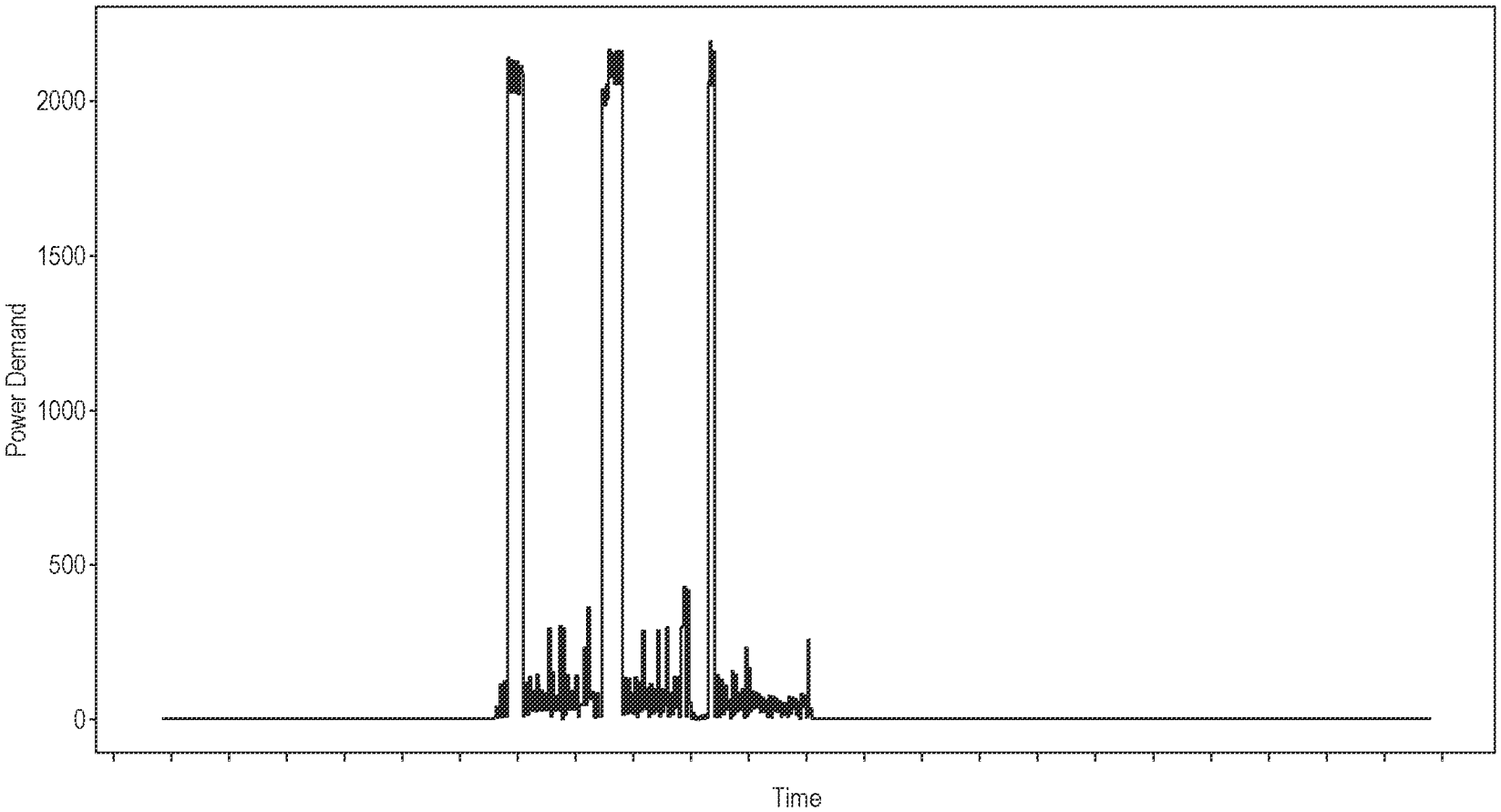
FIGS. 2A-2E illustrate power consumption of washing appliances.

A typical energy consumption pattern for a washing machine is depicted in FIG. 2A, showing electricity consumption (measured as electrical power) over time.

Note that the present disclosure uses the term "power consumption" to indicate generally the consumption of energy (specifically electrical energy) by appliances. In practice, energy consumption may be measured in terms of energy flow rate, i.e. electric power (energy per unit time, e.g. measured in Watt) or in terms of actual energy consumed over some interval (e.g. measured in Joule, kWh or other appropriate unit). Thus a time series of power consumption data as discussed herein may comprise a series of power values indicating power draw over respective time intervals or a series of energy values indicating total energy consumption over respective time intervals. Terms such as "power consumption" and "power consumption data" and the like are intended to encompass any suitable method or unit for measuring electrical energy used by appliances, and the terms "power consumption" and "energy consumption" may generally be used interchangeably.

A typical sequence of operation for a dishwasher or washing machine follows the following stages:

1. Fill
2. Wash (this involves water pumped through the dishwasher spray arms or motor agitations in a washing machine)
3. Drain out the water The process is repeated depending on the selected program and the durations of the stages may vary. FIG. 2A shows a number of stages of washing machine operation, which could e.g. correspond to wash, rinse and spin cycles.

Figure 2B:
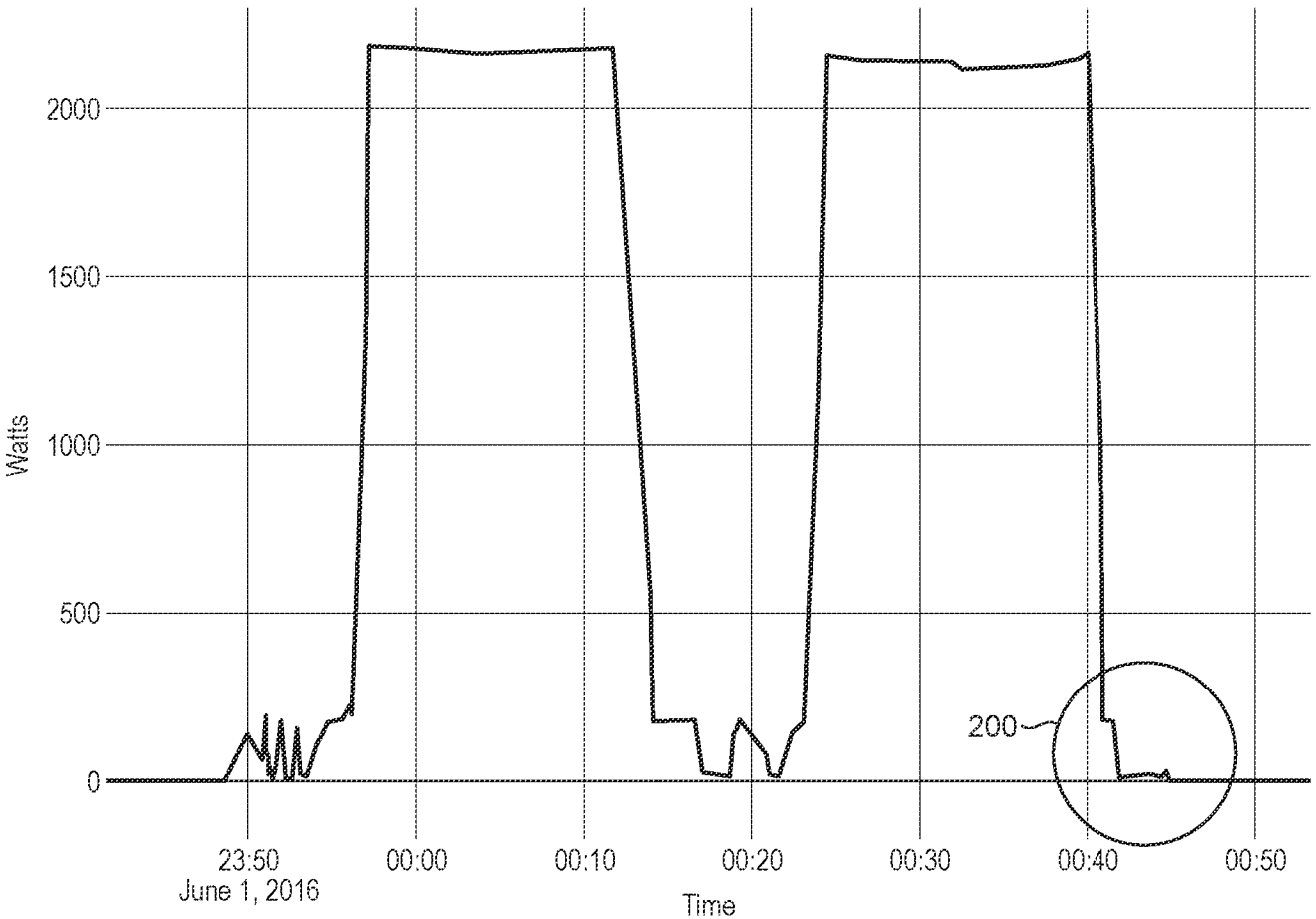

FIG. 2B illustrates part of an electricity consumption pattern of a washing machine in greater detail. Operation of the pump (marked at 200) is generally one of the last things to take place in the operating cycle and the consumption of the pump is typically small compared to other parts of the cycle (e.g. typically less than 100 watts). Generally, no other components will be operating during this stage of the cycle.

In particular examples, detection of flow obstructions is based on the operating duration of the appliance's drain pump. An extended operating time for the drainage pump (compared to a usual, normal or expected operating duration) is interpreted as symptomatic of a reduction in flow rate, and hence a likely presence of a flow obstruction.

Figure 2C:
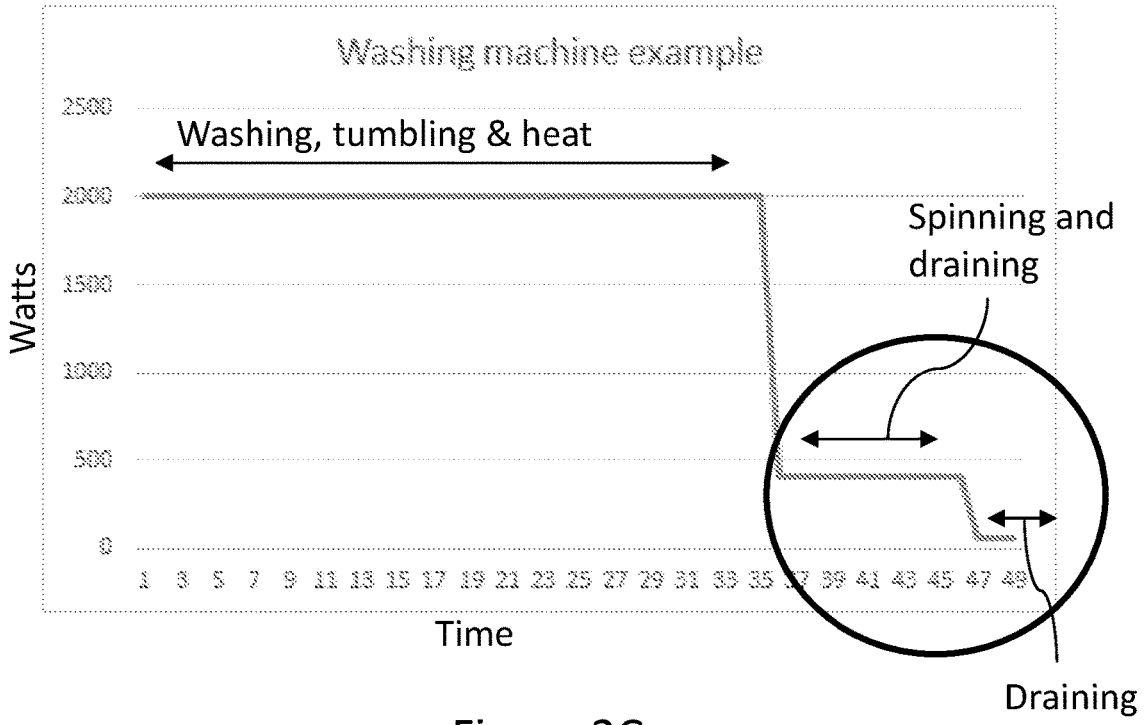

FIG. 2C illustrates the end of a typical wash cycle for a washing machine. The circled area shows part of the cycle where increased consumption may be seen due to extended operation of the pump to extract the water (e.g. due to scaling/blockages). Typically, the spin and drain process operates multiple times within the standard wash cycle and therefore the extended pump operation could alternatively/additionally be detected in the middle of the wash cycle.

Figure 2D:
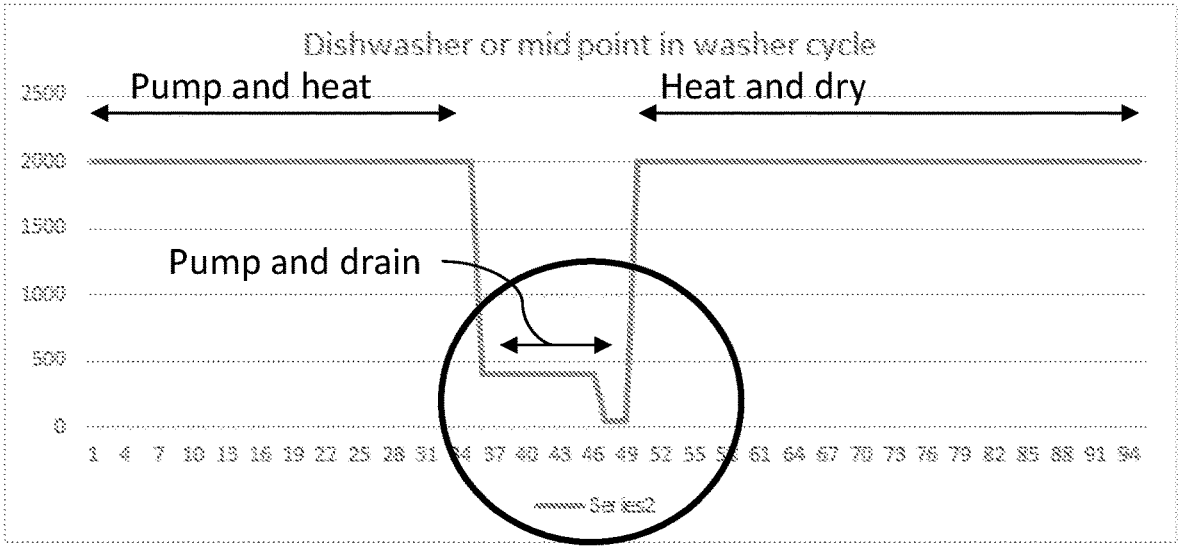

FIG. 2D shows part of the end of a typical dishwasher cycle. The circled area shows part of the cycle where increased consumption might be seen because the components (drain pump and/or circulating pump) are operating longer to extract the water (e.g. due to scaling/blockages). Again, the pump and drain operation may occur multiple times within the standard wash cycle and therefore the extended pump operation could alternatively/additionally be detected in the middle of the wash cycle.

Figure 2E:
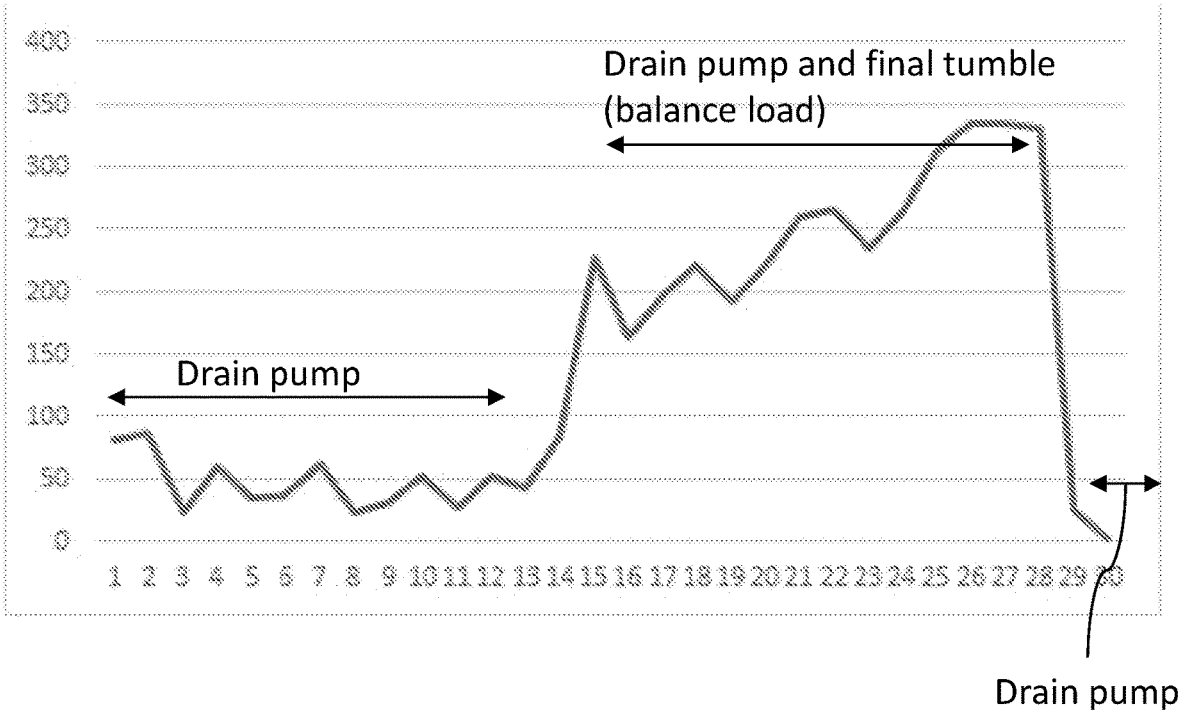

FIG. 2E shows another example of the final stages of a washing machine cycle, where a final drain pump operation is overlaid with an additional consumption signature of a final tumble operation where the drum is turned to balance the load. In this example, detection could be based on detecting the entire pump operation (including the period when the drum motor or other components are active), e.g. based on disaggregating the signal as described below, or could be based on detecting a particular phase of pump operation (e.g. the period before or after the final tumble). Thus a representative pump operation duration used to diagnose flow obstructions need not encompass the entire duration during which the pump is active.

Monitoring System

Figure 3:
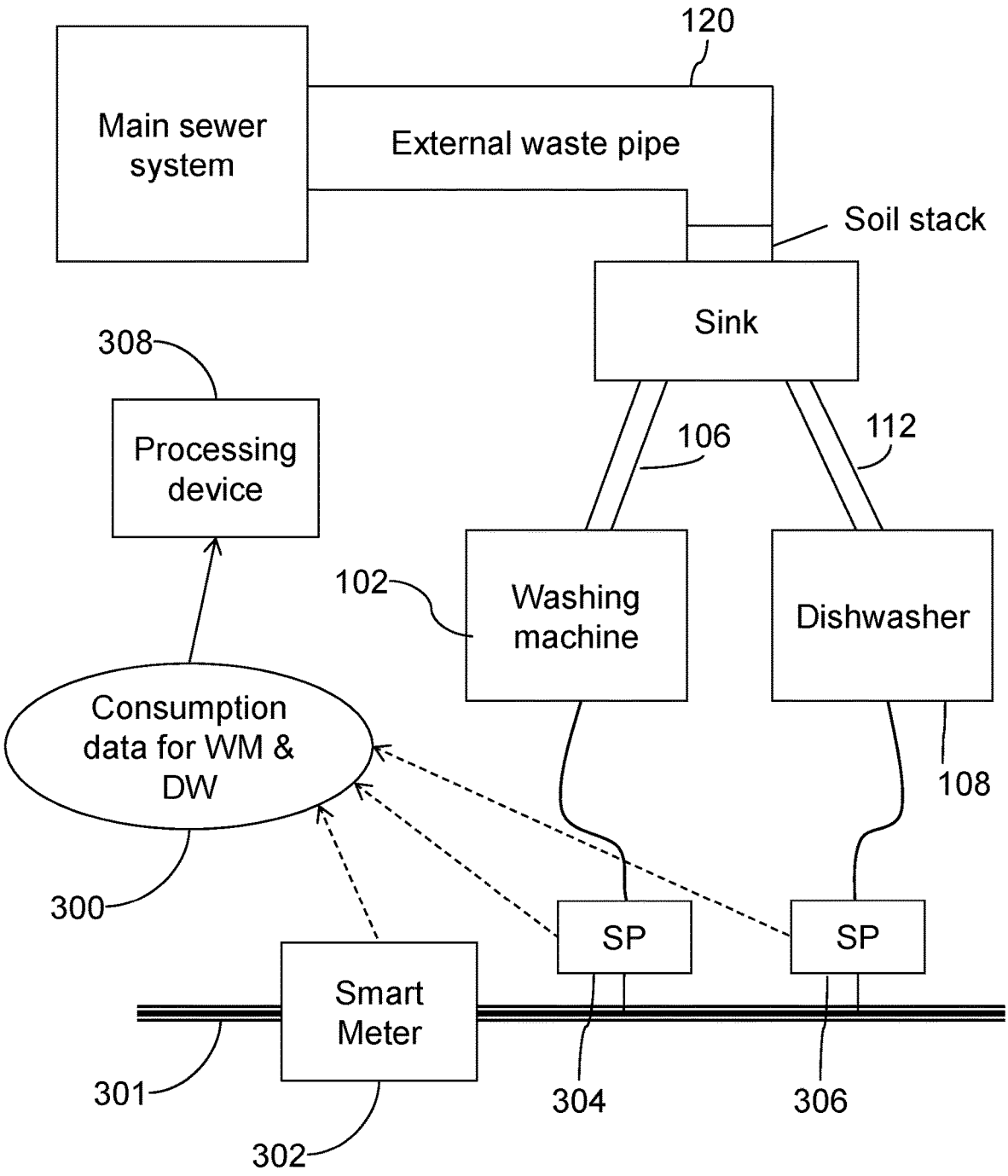
FIG. 3 illustrates a system for monitoring operation of washing appliances.

FIG. 3 illustrates a monitoring and detection system for detecting drainage flow restrictions associated with household washing appliances based on electricity consumption of the appliances. As in FIG. 1, washing appliances 102 and 108 drain via respective waste pipes 106, 112, in this case between the appliances and sink waste, leading via the external waste pipe 120 to the main sewer system.

Electricity consumption for each appliance is measured by a respective smart plug 304, 306 connected to each appliance. The smart plugs connect the appliances to the main electricity supply 301 and measure power consumed by the appliances from the supply. Smart plugs may typically be in the form of a standalone component arranged to be plugged into an electrical socket in the building's electricity supply network, and comprising another electrical socket for connection of an electrical appliance, along with power measurement, data processing and communication circuitry. Alternatively equivalent functions may be integrated directly into a permanently installed electrical socket in the building's supply network, or into the appliance itself.

Each smart plug measures power consumption and generates power consumption data 300 for the connected appliance. The power consumption data, typically in the form of a time series of power consumption measurements, is provided to a processing device 308 for storage and analysis.

Alternatively, power consumption may be measured centrally for the dwelling by a suitable power meter such as smart meter 302. Individual power consumption data for each appliance is then extracted from the whole-house power data by the processing device, e.g. using disaggregation techniques as described in GB2479790 or other suitable data processing techniques. In further variations, a combination of appliance-specific consumption data and whole-house consumption data may be used to derive consumption data for the appliances. In another variation, power consumption data for the drainage pump of the appliance may be extracted directly from the whole-house consumption data by disaggregation and used as the basis for subsequent analysis.

The consumption data 300 for the washing machine and dishwasher is then analysed by the processing device 308 to identify characteristics of the drainage pump operation. Based on the detected characteristics, the processing device then identifies problematic drainage conditions such as blockages and scaling in various parts of the system.

Figure 4:
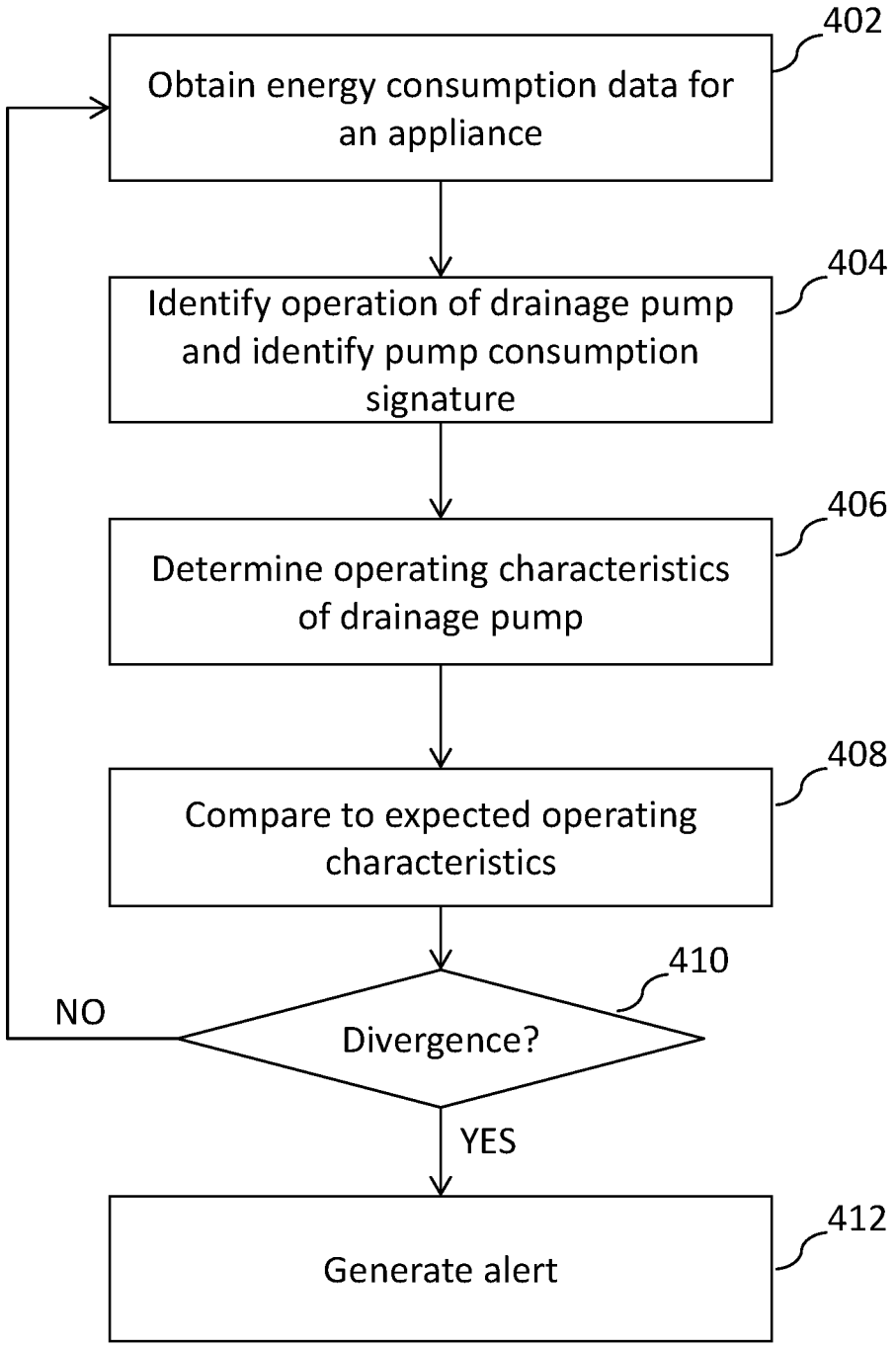
FIG. 4 illustrates a process for detecting a drainage condition associated with a washing appliance.

The basic process is illustrated in FIG. 4. In step 402, energy consumption data for a washing appliance (e.g. washing machine or dishwasher) is obtained. This is typically in the form of a time series of power consumption measurements, each measurement indicating power consumption over a respective time interval. In step 404, data indicative of power consumption of the drainage pump of the appliance is identified in (and/or extracted from) the time series of power data. This may involve identifying a time period during which the pump is operating, and extracting or otherwise utilising only the consumption measurements for the relevant time period, on the assumption that the pump is the only component operating at that time (or at least represents the predominant component of the power consumption). Alternatively, disaggregation may be performed (as described previously) to separate power data attributable to the pump from other contributions by other components of the appliance. The power data indicative of power consumption of the drainage pump of the appliance is referred to as the power consumption signature of the pump, and may again comprise a time series of power consumption values.

The operation of the pump may, for example, be detected based on a known (e.g. average or typical) power consumption level for the pump. For example, if it is known that the drainage pump for a particular appliance model consumes 10 W of power duration operation and that no significant consumption occurs in other parts of the appliance at the time, then a period of consumption at the known 10 W level may be identified as attributable to the pump. Alternatively, more complex pattern recognition algorithms may be applied to detect different stages of the appliance operating cycle e.g. based on comparing the known power consumption pattern of the appliance to the measured consumption pattern to identify specific events and stages in the cycle, including pump operation.

In step 406, one or more operating characteristics of the drainage pump are derived from the pump's power consumption signature. Preferably, the relevant detected operating characteristic is the operating duration of the pump, measured as the duration from a detected activation of the pump (pump on-time) to a subsequent detected deactivation of the pump (pump off-time). However, other characteristics may additionally or alternatively be determined, such as average/total power consumption of the pump over the active period, time period between separate pump activations etc.

In step 408, the system compares the determined operating characteristics to expected operating characteristics, for example by comparing the determined duration of operation of the drainage pump to an expected duration of operation. The expected duration (and/or other expected operating characteristics) may be known e.g. based on manufacturer-supplied data for the make/model of the appliance, or may be measured during an earlier learning phase where the normal operation of the specific appliance, or an appliance of equivalent type (make/model), is monitored to determine representative values for the operating characteristic (e.g. pump operating duration). Such investigations could be carried out in a laboratory setting, or in situ shortly after installation of the appliance, when it can be assumed that the appliance is operating close to optimally without scaling, blockages or other flow obstructions. Alternatively the specific appliance may be continuously monitored with the relevant operating characteristics (e.g. pumping duration) measured and stored, and the expected operating characteristics used for comparison being based on the past measurements for the specific appliance.

If a divergence from the expected characteristics (e.g. pump operating duration) is detected (test 410), where a divergence may be considered a deviation from expected value(s) beyond a predetermined tolerance threshold, then an alert is generated in step 412. This may involve, e.g. sending an electronic message to a user of the appliance (e.g. as an SMS or e-mail message) or to a manufacturer of the appliance, maintenance service provider, or the like. In one example, a message may be sent to a scheduling system for scheduling engineer visits.

If no divergence is detected, then the monitoring continues at step 402, with periodic monitoring of the energy consumption signature of the appliance (e.g. at predetermined monitoring intervals).

The above example process allows blockages and other flow restrictions to be detected that are associated with drainage operation of a particular appliance. In a variation of this approach, multiple appliances at a location may be monitored simultaneously, allowing more detailed information on drainage performance at the location to be obtained.

In particular, since many residential properties include both a dishwasher and a washing machine, monitoring of both appliances can be used to improve diagnosis of blockage conditions.

In this approach, sensing and detection is based on distinguishing obstructions specific to an appliance and obstructions in the shared drainage system. The following examples assume that the operating characteristic used for diagnosis is pump operating duration, but the process may be applied to other operating characteristics of the pump/appliance as discussed previously (e.g. power consumption).

In an embodiment the diagnostic process is able to identify three distinct states, outside of normal operation of the appliances:

1. Drain pump is operating longer than expected in the washing machine (but the dishwasher is operating normally)—this may imply scaling/blockage inside the washing machine or its immediate drain circuit
2. Drain pump is operating longer than expected in the dishwasher (but the washing machine is operating normally)—this may imply scaling/blockage inside the dishwasher or its immediate drain circuit
3. Drain pumps in both the washing machine and the dishwasher are operating longer than expected—this may imply scaling/blockage in the shared drainage system for the property, since flow obstructions in the main drain pipe would slow the output of water from both the dishwasher and washing machine.

A similar approach could of course be used whenever there are multiple appliances connected to a common drain system, and it is not necessary for the appliances to be of different types (e.g. the approach could be used to monitor multiple washing machines in a laundry or multiple dishwashers in a commercial kitchen). In a domestic setting, however, a combination of a single dishwasher and single washing machine is most typical and is therefore used as the example setting here.

For a property with only a single appliance, scaling and blockages relating to that appliance may still be detected (e.g. using the FIG. 4 process), but it may then not be possible to distinguish between blockages specific to the appliance and problems with the main drains.

In the multiple appliance example, the ability to distinguish automatically between appliance-specific problems and problems with a property's main drainage system allows repair activities to be focussed more effectively. If only one of the pumps is consuming more energy/operating for longer than usual, then a problem with the specific appliance/appliance outlet is detected and an appliance engineer visit may be arranged to address the problem. On the other hand, if both pumps were operating longer than expected, blockage of the main drain system can be diagnosed, in which case the appropriate service provider for addressing the problem would be a plumbing service.

Figure 5:
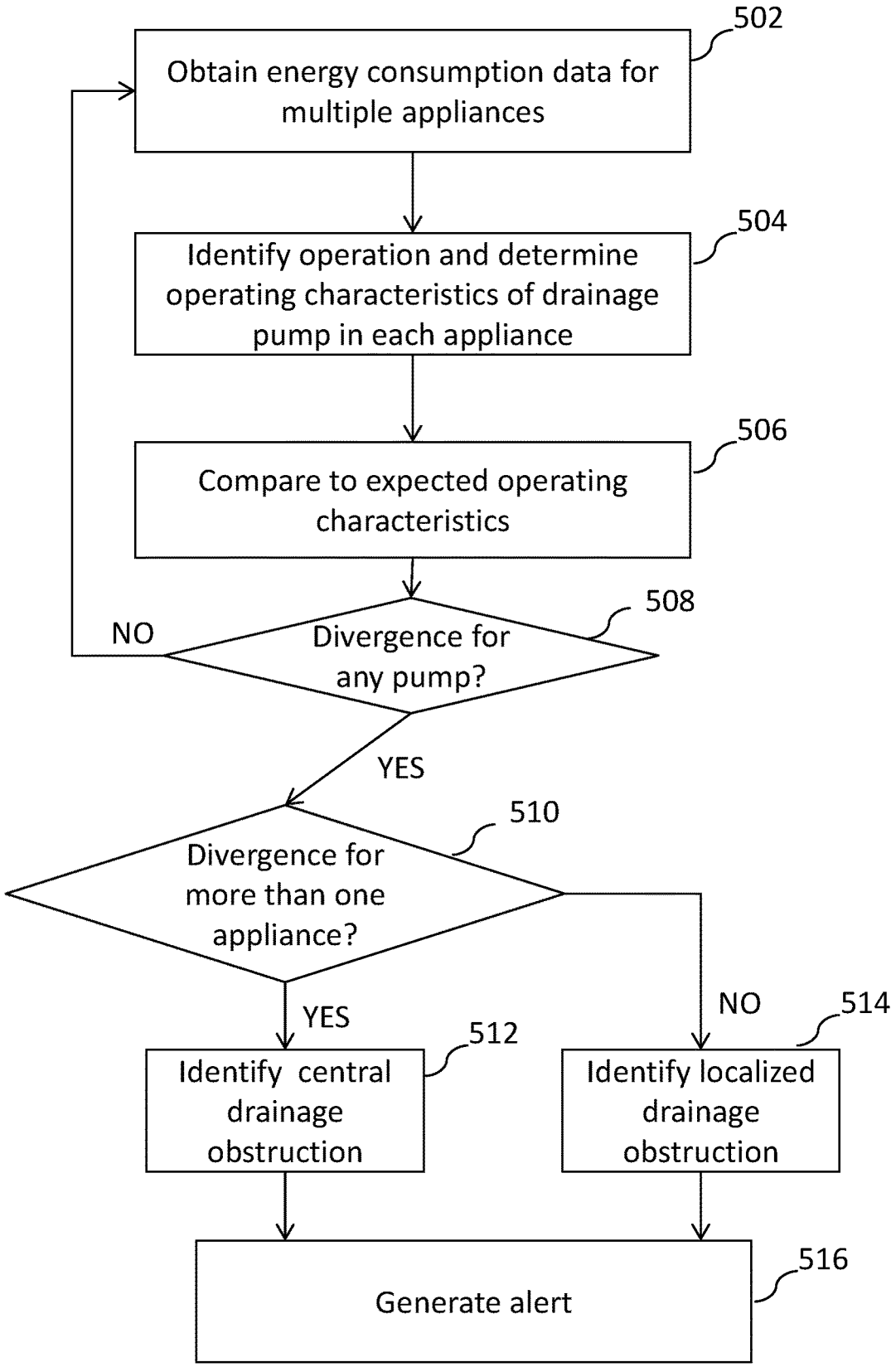
FIG. 5 illustrates a process for detecting a drainage condition associated with multiple washing appliances sharing a common drainage outlet.

The process for monitoring of multiple appliances is illustrated in FIG. 5. In step 502, energy consumption data for each of a set of appliances is obtained (e.g. a dishwasher and a washing machine). In step 504, operation of the drainage pump is identified and operating characteristics of the pump determined for each appliance. In a particular example this comprises the operating duration of the pump. In step 506, the operating characteristics are compared to expected operating characteristics (e.g. expected on-time of the pump). In step 508, the process determines whether operating characteristics for any of the pumps show a divergence from expected values. Note steps 502-508 essentially correspond to steps 402-410 of FIG. 4, but applied to multiple appliances (and the details of the process described above may thus be applied here). If none of the pumps show a divergence, then monitoring continues at periodic intervals in step 502.

If a divergence is detected for any of the appliances, then in step 510 the process determines whether a divergence has been found for more than one appliance (e.g. for both appliances in the example of a dishwasher/washing machine combination). If yes, then the system assumes that the divergent operation (e.g. extended run time) of the drainage pumps in multiple appliances is caused by a blockage or other flow restriction in a flow channel shared by both appliances, and thus in step 512 the process identifies a flow problem in the property's main drainage system. If the divergence exists for only a single appliance ("no" branch), then in step 514, a localized flow problem is identified that is specific to the particular appliance showing the divergence (e.g. showing a slow-running drainage pump). As indicated previously this could be due to obstruction in the outflow pipe of that appliance or within the appliance.

In step 516, an alert is generated (as discussed in relation to FIG. 4), e.g. as an electronic message to an appliance user or resident of the property or a to service provider. The alert may specify the type of flow problem detected (e.g. whether a central or localized flow problem was identified). Furthermore, the recipient of the alert may depend on the detected type of flow problem; e.g. a message may be sent to an appliance repair service in the case of a localised problem (514) or to a plumbing service in the case of a central drainage problem (512).

The described approaches can reduce the need for engineer visits through preventative alerts (e.g. allowing an appliance user to address blockages or minor scaling), and/or can increase successful outcomes for engineer visits, since engineers can be directed to the likely cause of problems, improving efficiency and avoid potential human error in the diagnostic process.

In any of the described approaches, the extent in deviation of drainage pump operating characteristics from expected values, for example the increase in pump run time, may additionally be used to evaluate the magnitude of the flow obstruction. For example an indicator of the obstruction severity may be calculated based on the difference between the measured value of the operating characteristic and the reference value, e.g. as a numerical value and/or a severity classification (e.g. identifying no/minor/moderate/severe flow restrictions).

Although the above description mentions duration of the drainage pump operation as the main operating characteristic used to detect flow obstructions, other characteristics of the appliances may be used. For example, durations of other readily detectable operational phases of the appliances (which include one or more drainage pump activations) may be identified and measured, and used as an indirect indicator of pump operation. Some specific examples of measurements that may be used are discussed in the following sections.

Example 1—Monitoring Total Cycle Durations

In this example, detection is based on total cycle duration of the washing appliance (e.g. complete execution of a wash program). The total cycle duration may be taken as an indirect indication of the operating duration of the drainage pump, which will operate at least once and possibly multiple times over the course of a whole cycle.

Figure 6A:
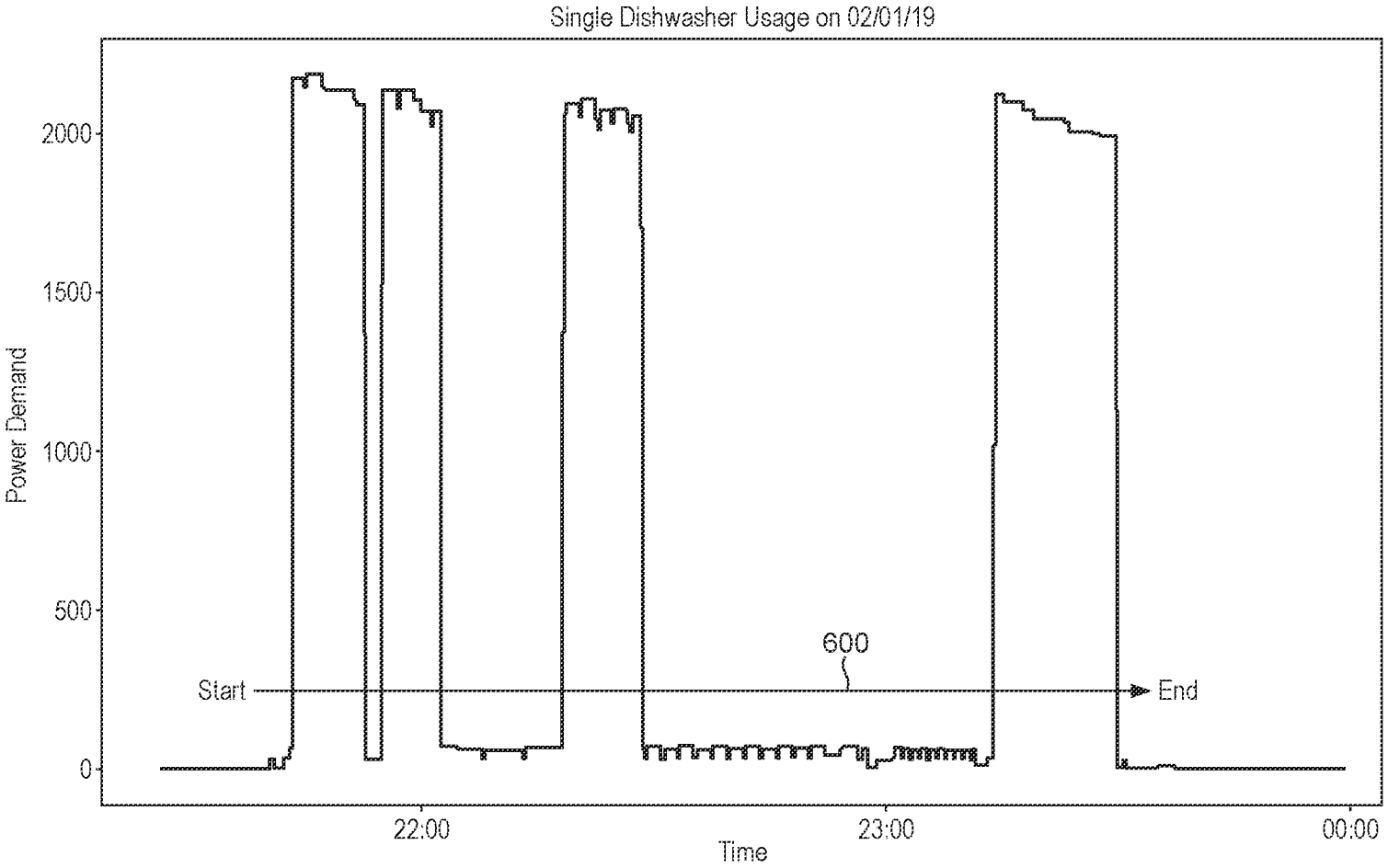
FIGS. 6A-6B, 7A-7B and 8 illustrate measurement of operating characteristics of appliances based on power consumption data.

For example, a normal cycle duration for a particular dishwasher may be 185 minutes (for a particular program). An example of power consumption data for a dishwasher is illustrated in FIG. 6A. A 5% (9.25 mins) or greater increase in total dishwasher cycle duration 600 may be taken to indicate that the dishwasher has scaling problems.

Figure 6B:
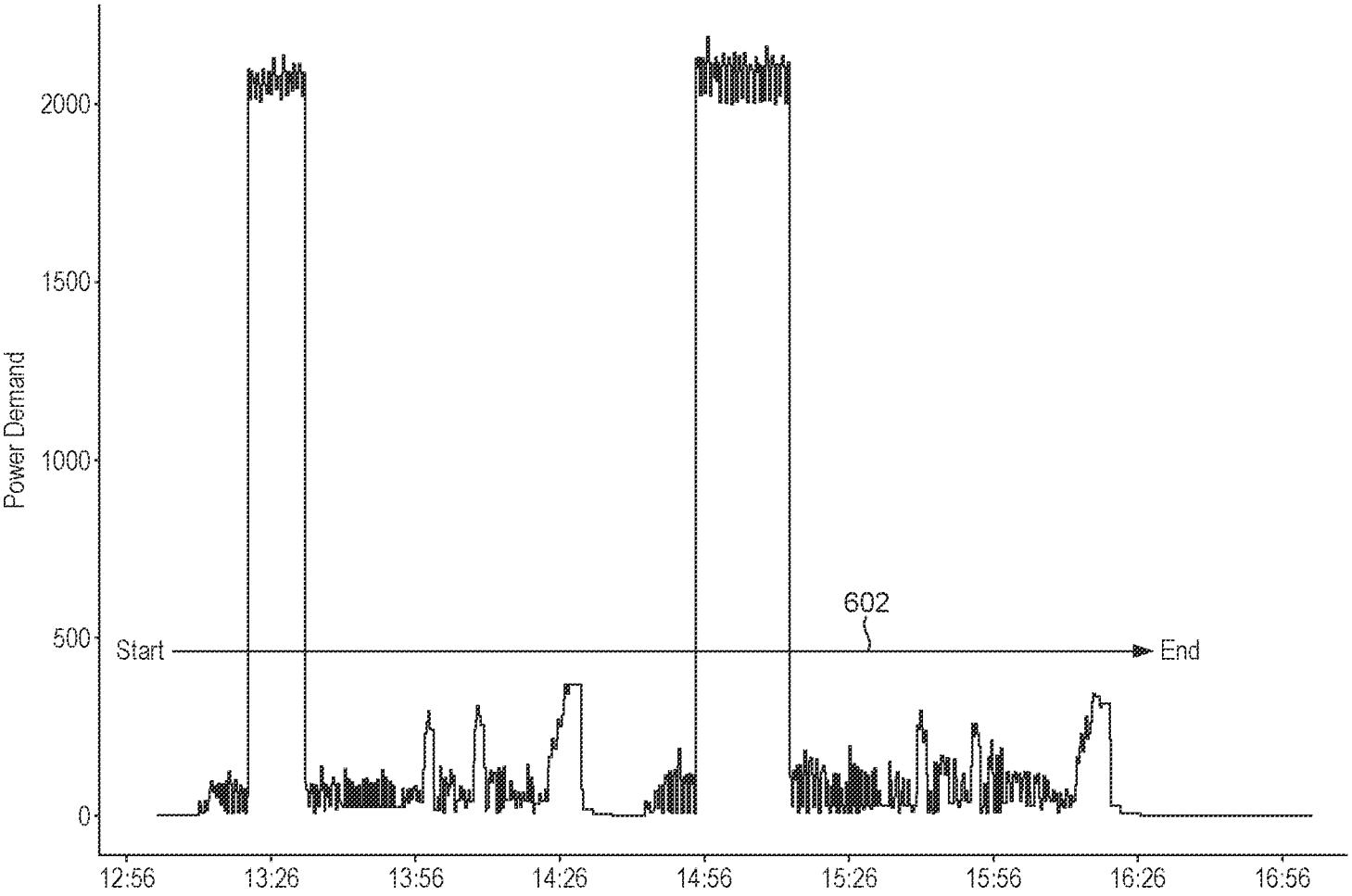

Similarly, a normal cycle duration for a particular washing machine may be 120 mins (full cycle including e.g. pre-wash, main wash and spin cycles, on a particular program). An example of a washing machine power consumption data set over a full cycle is shown in FIG. 6B. A 5% (6 mins) or greater increase in total duration 602 of the washing machine cycle may be taken as an indication that the washing machine has scaling problems.

A 5% duration (or greater) increase in the cycle durations for both appliances may be taken as an indication that the main drainage network of the house has scaling problems.

Example 2—Time Period Between Heater Activations

In this example, the system monitors the duration of time between activations of a heating element used in an appliance to heat wash water. Heater activation may be relatively easy to detect within the power consumption signal (e.g. due to high power draw spikes). Since the heater activation timings are determined by the wash program, the duration between activations may be used as a proxy for the overall cycle duration, and/or specifically for drainage pump operation (which may operate at least once and possibly multiple times between heater activations).

Figure 7A:
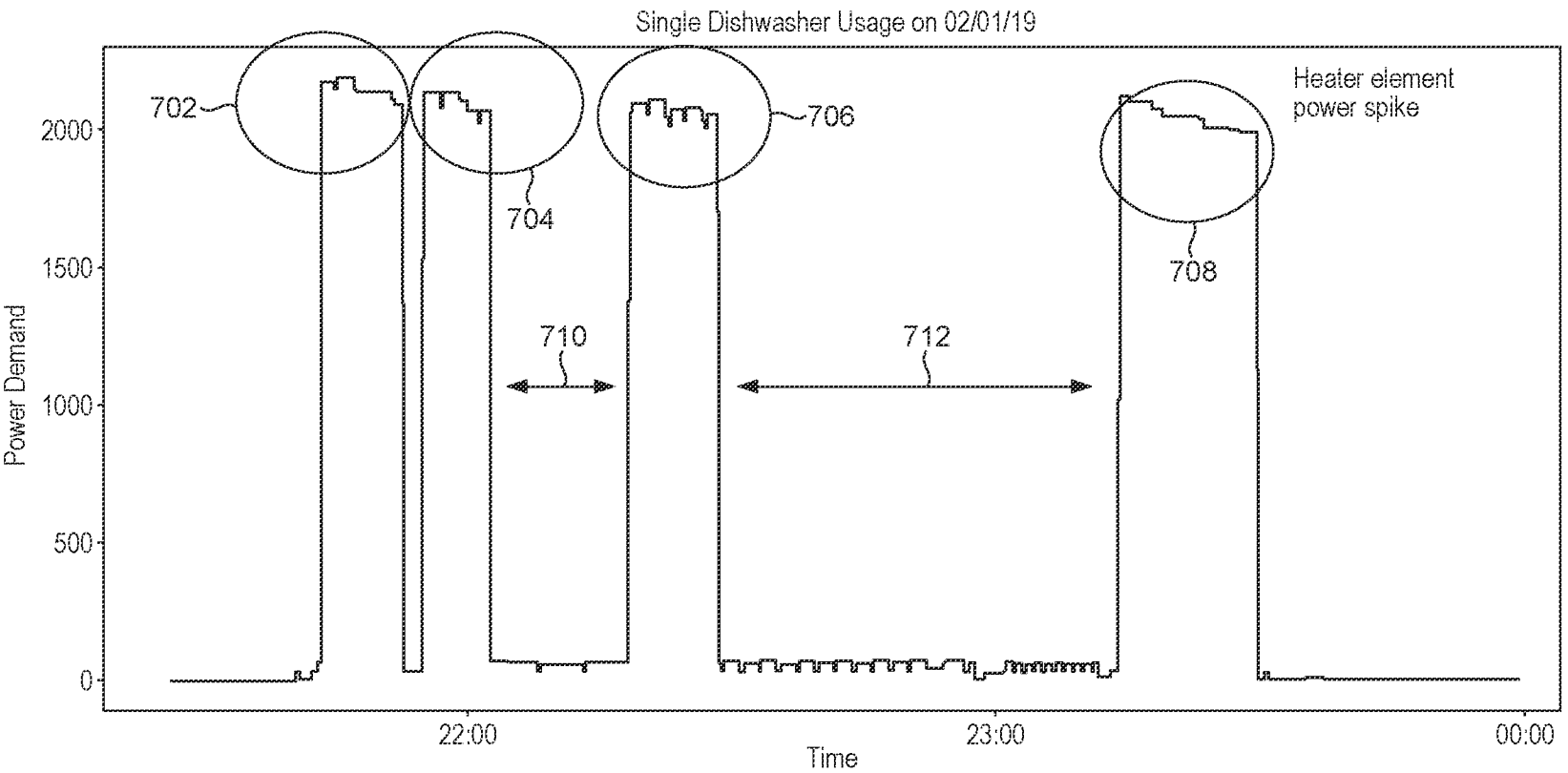

FIG. 7A illustrates power consumption for a dishwasher. The graph shows four consumption spikes 702, 704, 706, 708 caused by activation of the heating element. The system may measure one or more time periods between specific spikes (e.g. period 710 measured between spikes 704, 706 or period 712 measured between spikes 706, 708) or may determine a combined view of the differences between spikes (e.g. a total, average or other representative period duration for the periods between heater spikes). An increase of 5% (or greater) in the measured time period between heater activations may be taken as an indication of a discharge flow obstruction.

Figure 7B:
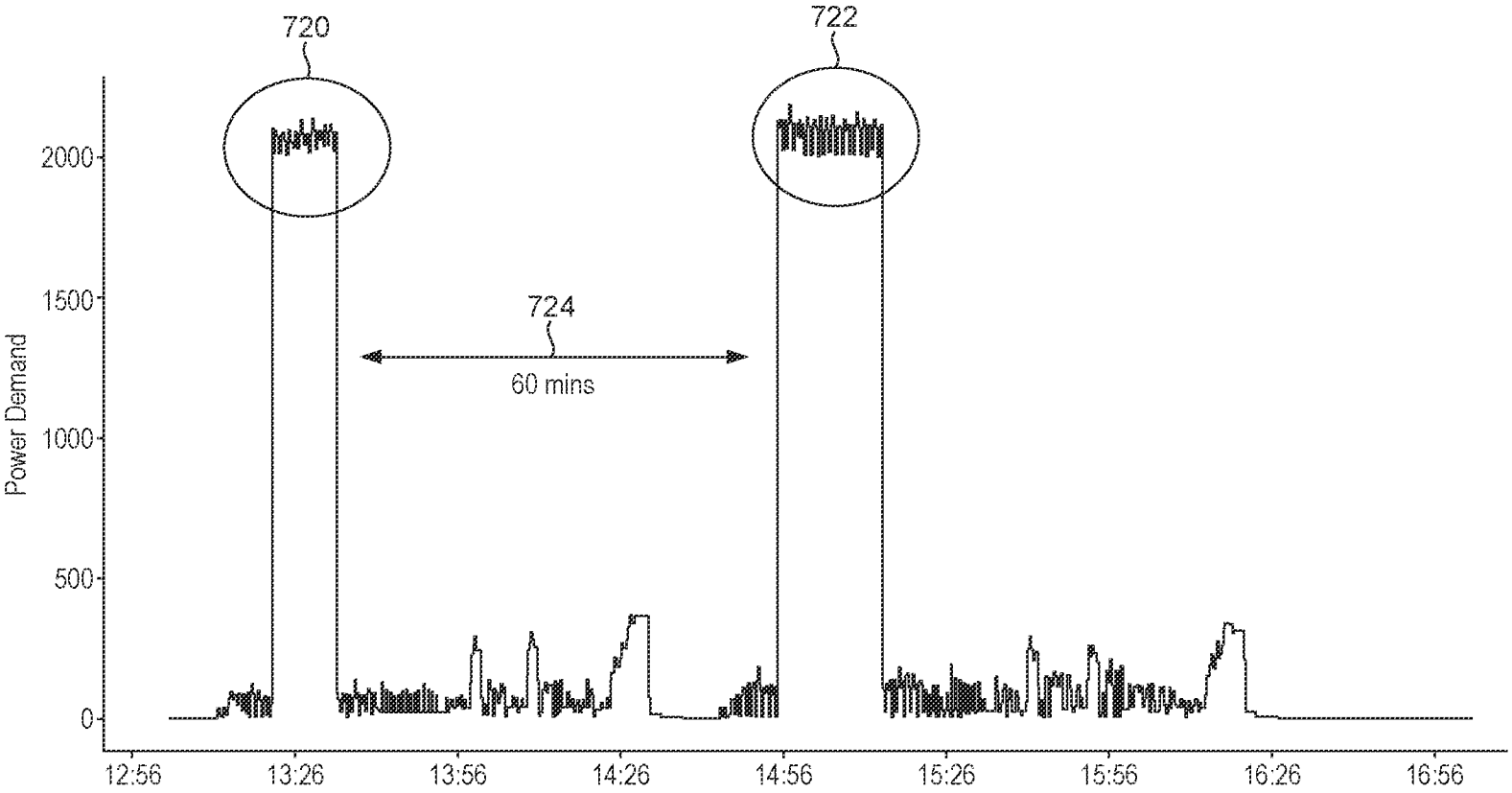

FIG. 7B illustrates power consumption for a washing machine. The graph shows two spikes 720, 722 corresponding to two separate activations of the washing machine heating element. In this example, the time period 724 between the end of the first heating element operation 720 and the start of the second heating element operation 722 is measured and baselined at 60 mins. If this time period increases by 5% (3 mins) this may be taken as indicative of scaling or other flow obstruction.

As in the previous example, if both appliances show a 5% (or greater) increase in the time intervals between heating element operation the algorithm would diagnose a flow obstruction in the main drainage plumbing for the house, rather than a problem specific to one appliance.

In both cases, the duration between spikes may be measured between the end of one spike and start of the next (as depicted) or vice versa, or alternatively between respective start times, respective end times or respective spike centres. The spikes themselves may be identified e.g. based on a predetermined energy consumption threshold, which may be a known quantity specific to the appliance make/model and determined by the manufacturer.

Example 3—Detection of Drain Pump Run Time

In this approach the drain pump run time is determined explicitly.

Typically, drain pumps extract water within approx. 120 seconds, however when pipes in the circuit begin to scale this time will gradually increase (e.g. by up to 3 times).

Figure 8:
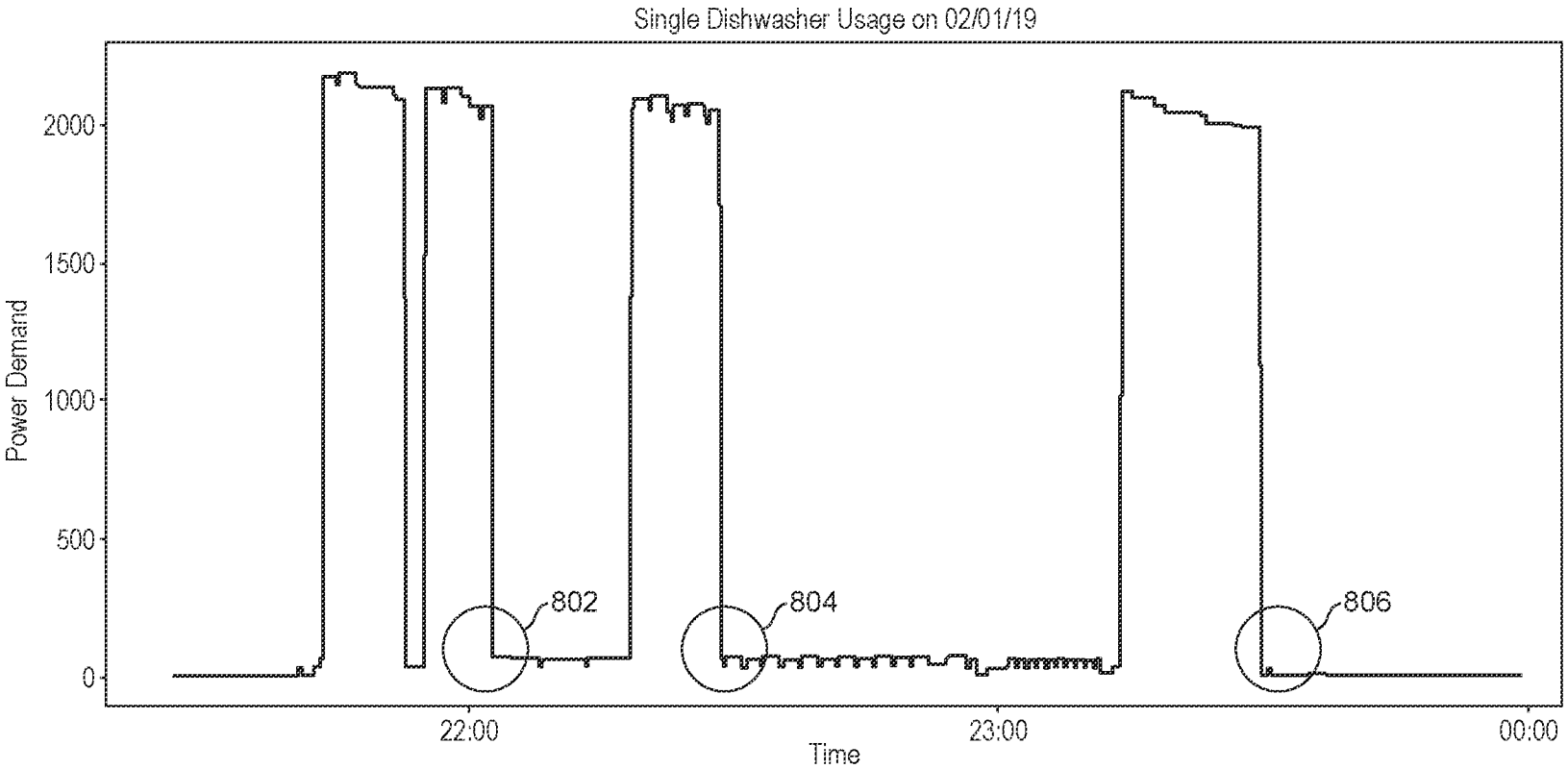

The system detects the drain pump operation within the cycle and measures the run time (i.e. the duration of time for which the drainage pump is in operation) in order to identify increases in run times. FIG. 8 illustrates power consumption of a dishwasher over time, with three periods 802, 804, 806 marked during which operation of the pump is detected. Pump operation may be monitored every time the drain pump is activated within the cycle or only at a specific activation, for example when the appliance empties the water just after the final rinse (e.g. 806).

Once the pump run time is determined this is then compared to historical or expected values, and an increase in pump run time of 5% or more is taken as indicative of a scaling or other flow obstruction problem. Where multiple run times are measured, each may be compared separately to historical or expected values, or a representative value (e.g. total/average) may be used.

The same approach is used for detecting and measuring pump operating time for a washing machine drainage pump.

As per previous examples, if both the dishwasher and washing machine have longer drain pump run times the system determines that there is a flow obstruction such as scaling in the shared drainage plumbing of the property, whereas if an extended run time is determined for only one of the appliances then a problem specific to that appliance is identified.

Note that in all of the above examples as discussed in relation to FIGS. 6A-8, the depicted power consumption datasets show the power demand (amount of power consumed e.g. measured in kWh) indicated as continuous power draw over time (over the cycle duration).

In all of the examples, the 5% threshold for detecting an abnormal cycle/interval/pump run time duration is given purely by way of example and may be varied as needed. An appropriate threshold may e.g. be selected based on observations of real appliance installations with drainage problems, or based on laboratory observations or theoretical considerations. Thresholds may be specified in relative terms (e.g. as percentage deviation from an expected value) or in absolute terms (e.g. as a time value).

Computer System

Figure 9:
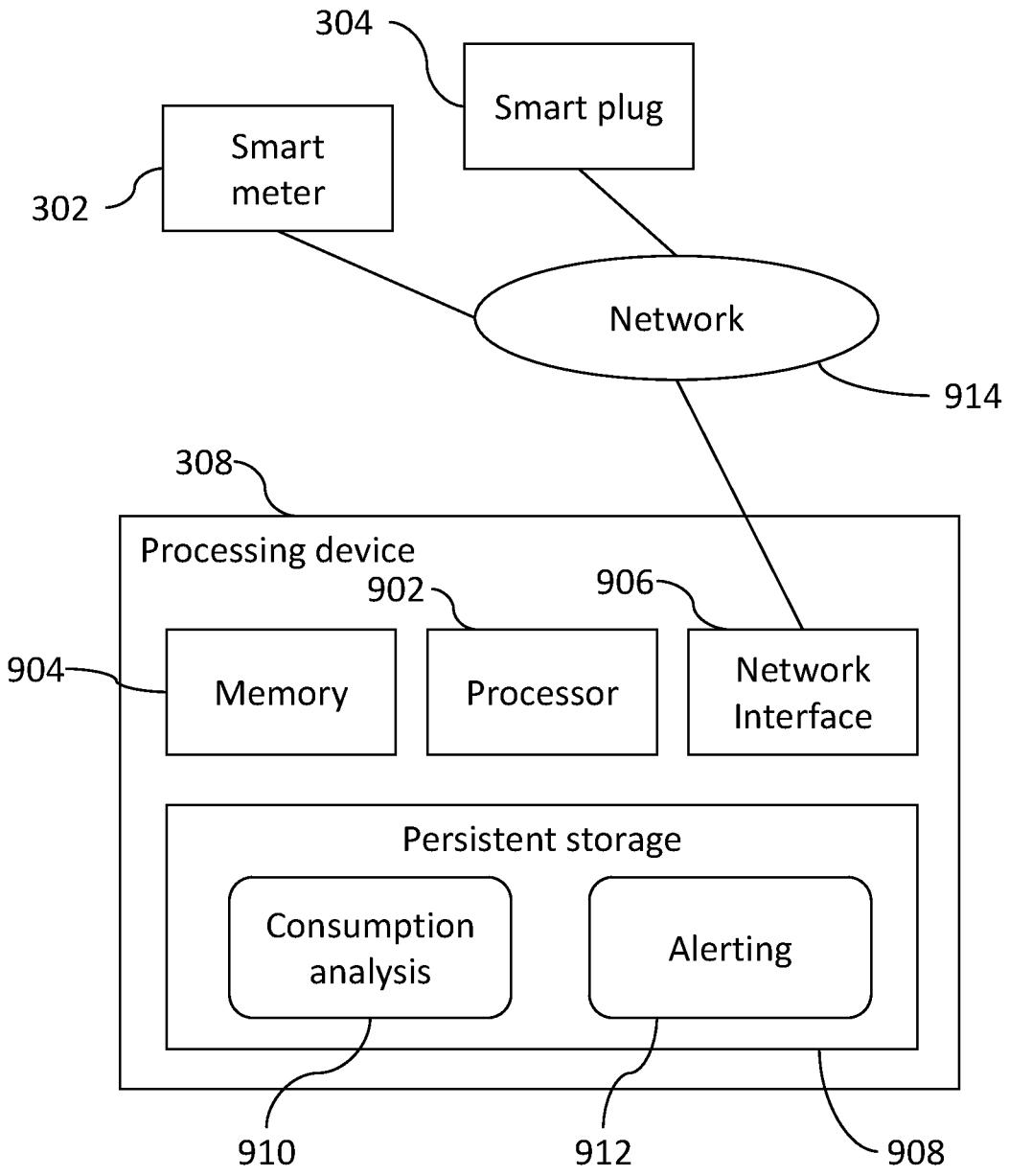
FIG. 9 illustrates a processing device for analysing power consumption data.

FIG. 9 illustrates the hardware/software architecture of a processing system suitable for implementing described processes. The system includes the processing device 308 e.g. in the form of a conventional personal computer or server, smartphone or other mobile computing/communications device, smart home hub or the like. The processing device includes one or more processors 902 (e.g. standard Intel/AMD desktop processors, ARM-based mobile processors, embedded processors etc.) together with volatile/random access memory 904 for storing temporary data and software code being executed.

A network interface 906 is provided for communication with other system components (e.g. smart meter 302 or smart plug 304) over one or more networks (e.g. Local or Wide Area Networks, including the Internet). In one example the network may include a local wireless network installed in the property for supporting smart home functions, e.g. based on WiFi, Bluetooth, Zigbee or other communications standards and protocols.

Persistent storage 908 (e.g. in the form of hard disk storage, optical storage and the like) persistently stores software modules for performing the described functions, including a consumption analysis process 910 for analysing appliance consumption data, detecting operational characteristics (e.g. duration of drainage pump operation) and diagnosing flow obstructions, and a user alert module 912 for generating alerts e.g. in the form of electronic messages/notifications sent to appliance users, service providers, manufacturers etc. The alerting module may also provide direct access to the results of the data analysis, e.g. via a front-end user interface accessible using a smartphone app, web interface or the like.

The persistent storage also includes other software and data (not shown), such as an operating system. Furthermore, the processing device will include other conventional hardware and software components as known to those skilled in the art, and the components are interconnected by data buses (e.g. in the form of a memory bus between memory 904 and processor 902, and an I/O bus between the processor 902, network interface 906 and a storage controller for persistent storage 908 etc.)

While a specific architecture is shown by way of example, any appropriate hardware/software architecture may be employed. Furthermore, functional components indicated as separate may be combined and vice versa. For example, the functions of processing device 308 may in practice be implemented by multiple separate processing devices. The processing device may be provided at the same location (e.g. within the same house) as the appliances being monitored or may be located remotely, for example in the form of a cloud server connected to the metering devices 302, 304 over the Internet. Such a cloud server (or server cluster) may provide the described monitoring, analysis and alerting functions for a number of dwellings/premises, for example operating as a centralised monitoring system for monitoring appliances and providing alerts and repair services across a large customer base.

It will be understood that the present invention has been described above purely by way of example, and modification of detail can be made within the scope of the invention.

The invention claimed is:

1. A method of monitoring drainage of first and second washing appliances, each having a pump for draining a washing chamber, the method comprising:

receiving a time series of power consumption data relating to the operation of the first washing appliance over a monitored period of operation including pumped draining of the washing chamber of the first washing appliance, wherein the power consumption data indicates power consumed by the first washing appliance from a supply and is obtained using one of:

a power metering device connected to the first washing appliance arranged to measure the power consumption of the first washing appliance; and a power metering device for monitoring overall power consumption at a user environment comprising a plurality of power-consuming devices including the first washing appliance;

deriving, from the time series of power consumption data, a first measure of the duration of a portion of the monitored period comprising said pumped draining;

comparing the first measure of duration to a first reference value;

monitoring operation of the second washing appliance, wherein the first and second washing appliances share a common drainage outlet, said monitoring comprising deriving a second measure of the duration of a portion of operation comprising pumped draining of the washing chamber of the second washing appliance;

comparing the second measure of duration to a second reference value; and based on comparing the first and second measures of duration to said first and second reference values for the first and second washing appliances, determining an indicator of a drainage obstruction of one or more of: the first washing appliance, the second washing appliance, and the common drainage outlet.

2. A method according to claim 1, wherein the first reference value is predetermined, optionally as a reference value determined independently of the operation of the first washing appliance and/or determined for an appliance type corresponding to the first washing appliance.

3. A method according to claim 1, wherein the first reference value is determined based on one or more previous measures of duration of operating periods comprising pumped draining determined for the first washing appliance.

4. A method according to claim 1, wherein the drainage obstruction is identified by the indicator as one of:

an obstructed drainage path within or from the first washing appliance if the first measure of duration is greater than the first reference value and the second measure of duration is not greater than the second reference value, an obstructed drainage path within or from the second washing appliance if the second measure of duration is greater than the second reference value and the first measure of duration is not greater than the first reference value; and an obstruction in the common drainage outlet if the first measure of duration is greater than the first reference value and the second measure of duration is greater than the second reference value.

5. A method according to claim 4, wherein a magnitude of the indicator is determined based on one of: a difference between the first measure of duration and the first reference value; and a difference between the second measure of duration and the second reference value.

6. A method according to claim 1, wherein the time series of power consumption data is received from a power metering device for monitoring overall power consumption at a user environment comprising a plurality of power-consuming devices including the first washing appliance, the method further comprising processing a power consumption signal for the plurality of devices to determine the time series of power consumption data for the first washing appliance and/or the drainage pump of the appliance, optionally by disaggregating the power consumption signal to identify a contribution to the signal from the appliance and/or drainage pump.

7. A method according to claim 1, wherein deriving the first measure of the duration comprises one of:

identifying, from the power consumption data, start and end points of a cycle of operation of the first washing appliance, and using the total duration of a cycle of operation of the first washing appliance as said measure;

identifying, from the power consumption data, periods of operation of a predetermined component of the first washing appliance, optionally a heating element of the first washing appliance, and using a duration between identified periods as said measure;

identifying, from the power consumption data, start and end points of operation of the pump of the first washing appliance and determining the measure from the start and end points, wherein the first measure of duration is a measure of the duration of said pumped draining.

8. A method of monitoring drainage of first and second washing appliances connected to a common drainage outlet, said first and second washing appliances each having a pump for draining a washing chamber, the method comprising:

receiving a first data set of power consumption data relating to the operation of the first washing appliance over a monitored period of operation including pumped draining of the washing chamber of the first washing appliance, the first data set of power consumption data indicating power consumed by the first washing appliance from a supply;

deriving a first operating characteristic of the operation of the first washing appliance during the monitored period from the first data set;

receiving a second data set of power consumption data relating to the operation of the second washing appliance over a monitored period of operation including pumped draining of the washing chamber of the second washing appliance, the second data set of power consumption data indicating power consumed by the second washing appliance from the supply;

deriving a second operating characteristic of the operation of the second washing appliance during the monitored period from the second data set;

wherein the first and second data sets of power consumption data are obtained using one of:

respective power metering devices connected to the first and second washing appliances arranged to measure the power consumption of the first and second washing appliances; and a power metering device for monitoring overall power consumption at a user environment comprising a plurality of power-consuming devices including the first and second washing appliances;

the method further comprising determining an indicator of a drainage condition of at least one of the first and second washing appliances and the common drainage outlet, based on the operating characteristics derived for the first and second washing appliances, wherein the drainage condition comprises at least one of:

an obstructed drainage path associated with the first appliance;

an obstructed drainage path associated with the second appliance; and an obstruction in the common drainage outlet.

9. A method according to claim 8, wherein the obstructed drainage path associated with the first appliance is an obstructed drainage path within the first appliance or in a drainage channel connecting the first appliance to the common drainage outlet; and wherein the obstructed drainage path associated with the second appliance is an obstructed drainage path within the second appliance or in a drainage channel connecting the second appliance to the common drainage outlet.

10. A method according to claim 8, wherein determining an indicator of a drainage condition comprises comparing the first and second operating characteristics to respective first and second expected operating characteristics to identify a deviation from the expected operating characteristic.

11. A method according to claim 10, wherein the drainage condition is identified as an obstructed drainage path associated with the first appliance if the derived operating characteristic deviates from the expected operating characteristic for the first appliance but not the second appliance.

12. A method according to claim 10, wherein the drainage condition is identified as an obstructed drainage path associated with the second appliance if the derived operating characteristic deviates from the expected operating characteristic for the second appliance but not the first appliance.

13. A method according to claim 10, wherein the drainage condition is identified as an obstruction in the common drainage outlet if the derived operating characteristic deviates from the expected operating characteristic for both first and second appliances.

14. A method according to claim 8, wherein the first and/or second operating characteristics are indicative of operation of the drainage pump of the respective appliance.

15. A method according to claim 8, wherein the first and/or second operating characteristics comprise one or more of:

a cycle duration of the washing appliance;

a duration between activations of a heater element of the washing appliance;

a duration of operation of the drainage pump of the washing appliance;

a power consumption of the drainage pump of the washing appliance.

16. A method according to claim 8, wherein the first and/or second washing appliance is one of: a dishwasher; and a washing machine.

17. A method according to claim 8, comprising outputting the determined indicator or the drainage condition, or generating an alert or sending an electronic message indicating the drainage condition based on the determined indicator, optionally in response to the indicator being indicative of a drainage obstruction, the alert or message optionally sent to one or more of:

an owner or user of the first or second washing appliance;

a manufacturer or maintenance service provider for the first or second washing appliance;

a computer system for managing appliance and/or plumbing maintenance and/or scheduling repair services.

18. A non-transitory computer readable medium storing software code adapted, when executed on a data processing system, to perform a method of monitoring drainage of first and second washing appliances, each having a pump for draining a washing chamber, including steps of:

receiving a time series of power consumption data relating to the operation of the first washing appliance over a monitored period of operation including pumped draining of the washing chamber of the first washing appliance, wherein the power consumption data indicates power consumed by the first washing appliance from a supply and is obtained using one of:

a power metering device connected to the first washing appliance arranged to measure the power consumption of the first washing appliance; and a power metering device for monitoring overall power consumption at a user environment comprising a plurality of power-consuming devices including the first washing appliance;

deriving, from the time series of power consumption data, a first measure of the duration of a portion of the monitored period comprising said pumped draining;

comparing the first measure of duration to a first reference value;

monitoring operation of the second washing appliance, wherein the first and second washing appliances share a common drainage outlet, said monitoring comprising deriving a second measure of the duration of a portion of operation comprising pumped draining of the washing chamber of the second washing appliance;

comparing said second measure of duration to a second reference value; and based on comparing the first and second measures of duration to said first and second reference values for the first and second washing appliances, determining an indicator of a drainage obstruction of one or more of: the first washing appliance, the second washing appliance, and the common drainage outlet.

* * * * *